US010279992B2

(12) United States Patent
Lisin et al.

(10) Patent No.: US 10,279,992 B2
(45) Date of Patent: May 7, 2019

(54) THERMALLY INSULATED RESERVOIR

(71) Applicants: Public Joint Stock Company "Transneft", Moscow (RU); Joint-stock company "Transneft Siberia", Tyumen (RU); L.L.C. "Transneft Research and Development Institute for Oil and Oil Products Transportation", Moscow (RU)

(72) Inventors: Yury Viktorovich Lisin, Moscow (RU); Nikolai Nikolaevich Skuridin, Moscow (RU); Vitaly Ivanovich Surikov, Balashikha (RU); Anatoly Evgenevich Soshchenko, Moscow (RU)

(73) Assignees: PUBLIC JOINT STOCK COMPANY "TRANSNEFT", Moscow (RU); JOINT-STOCK COMPANY "TRANSNEFT SIBERIA", Tyumen (RU); L.L.C. "TRANSNEFT RESEARCH AND DEVELOPMENT INSTITUTE FOR OIL AND OIL PRODUCTS TRANSPORTATION", Moscow (RU)

( * ) Notice: Subject to any disclaimer, the term of this patent is extended or adjusted under 35 U.S.C. 154(b) by 163 days.

(21) Appl. No.: 15/226,886

(22) Filed: Aug. 2, 2016

(65) Prior Publication Data

US 2016/0340113 A1 Nov. 24, 2016

Related U.S. Application Data

(63) Continuation of application No. PCT/RU2014/000222, filed on Mar. 28, 2014.

(51) Int. Cl.

| | |
|---|---|
| ***B65D 90/06*** | (2006.01) |
| ***E04H 7/06*** | (2006.01) |
| ***B65D 81/38*** | (2006.01) |

(52) U.S. Cl.
CPC ..... *B65D 90/06* (2013.01); *B65D 81/3816* (2013.01); *E04H 7/06* (2013.01)

(58) Field of Classification Search
CPC ..... B65D 90/06; B65D 81/3816; E04H 7/06; F17C 3/02; F17C 3/04; F17C 13/001; F17C 2260/033; E04B 1/762; E04B 1/78
(Continued)

(56) References Cited

U.S. PATENT DOCUMENTS 1,972,508 A 9/1934 Zeiner
2,362,557 A * 11/1944 Jahns ..... F16L 23/08 285/192

(Continued)

FOREIGN PATENT DOCUMENTS

CN 204693030 10/2015
CN 205118646 3/2016

(Continued)

OTHER PUBLICATIONS

Owens Corning Foamglas (PDF Documents attached).*

(Continued)

*Primary Examiner* — Stephen J Castellano
(74) *Attorney, Agent, or Firm* — One LLP; Jonathan Jaech

(57) ABSTRACT

A heat-insulated tank with a volume of 200-20,000 $m^3$ for storage of oil and oil products includes a heat-insulated wall, roof and bottom installed on a foundation. The wall and roof are equipped with supporting discharge skirts forming sections, the heat-insulated coating made of foam glass blocks that fill sections and form control joints in the heat insulation (Continued)

coating. The tank includes a top coat made of metal sheets located at an external surface of foam glass blocks. The foam glass blocks including a lower row of detachable blocks and additional rows coupled to each other and a surface of the tank via an adhesive. The technical result is improved safety and strength of the tank heat insulation at loads on its structure caused by filling and discharge of the raw material and environmental factors, and relatively even temperature control of the oil and oil products.

20 Claims, 3 Drawing Sheets

(58) Field of Classification Search
USPC ..... 220/560.15; 52/745.01
See application file for complete search history.

(56) References Cited

U.S. PATENT DOCUMENTS

| | | | | |
|---|---|---|---|---|
| 3,122,259 | A | 2/1964 | Meesen | |
| 3,246,479 | A | 4/1966 | Kelley | |
| 3,378,162 | A | 4/1968 | Smith | |
| 3,400,849 | A * | 9/1968 | Pottier | F17C 3/005 220/560.06 |
| 3,931,424 | A * | 1/1976 | Helf | F17C 3/04 428/33 |
| 3,952,469 | A | 4/1976 | Dudzinski | |
| 4,045,922 | A * | 9/1977 | Elliott | B60P 3/32 52/408 |
| 4,062,468 | A | 12/1977 | Bongiovanni | |
| 4,065,019 | A | 12/1977 | Letourneur et al. | |
| 4,073,976 | A | 2/1978 | Dudzinski | |
| 4,116,150 | A | 9/1978 | McCown | |
| 4,155,787 | A | 5/1979 | DeSadier | |
| 4,555,283 | A | 11/1985 | Thesenfitz | |
| 5,657,594 | A * | 8/1997 | Morita | E04B 1/80 220/560.05 |
| 6,035,795 | A | 3/2000 | Dhellemmes et al. | |
| 6,199,497 | B1 | 3/2001 | Dhellemmes et al. | |
| 6,360,545 | B1 * | 3/2002 | Goldstone | E04H 7/18 52/404.2 |
| 7,171,916 | B2 | 2/2007 | Yang et al. | |
| 8,317,056 | B2 | 11/2012 | Lee et al. | |
| 8,381,939 | B2 | 2/2013 | Schultz et al. | |
| 8,603,375 | B2 | 12/2013 | Simmons et al. | |
| 8,615,946 | B2 | 12/2013 | Oberg | |
| 8,783,501 | B2 | 7/2014 | Mookerjee | |
| 9,027,304 | B2 | 5/2015 | McClure | |
| 2007/0181586 | A1 | 8/2007 | Van Ootmarsum et al. | |
| 2011/0168722 | A1 | 7/2011 | Baudat et al. | |
| 2012/0325821 | A1 | 12/2012 | Mookerjee | |
| 2013/0180996 | A1 | 4/2013 | Lee et al. | |
| 2014/0255628 | A1 | 9/2014 | Fesmire | |
| 2015/0369428 | A1 | 12/2015 | Ducoup et al. | |

FOREIGN PATENT DOCUMENTS

| | | |
|---|---|---|
| GB | 907860 | 10/1962 |
| KR | 101207894 | 4/2012 |
| RU | 2079620 | 5/2007 |
| RU | 117467 | 6/2012 |
| RU | 2558907 | 8/2015 |
| WO | WO1988/003630 | 5/1988 |
| WO | WO2015/052446 | 4/2015 |
| WO | WO2016/046487 | 3/2016 |
| WO | WO2016/097578 | 6/2016 |

OTHER PUBLICATIONS

Dickey, Allen; "*Cellular Glass on LNG Systems*"; Insulation Outlook Magazine, Aug. 2015, http://www.insulationoutlook.com/io/article.cfm?id=IO150801; (8 pages).

Vertical Tank Insulation Systems by Pittsburgh Corning; "*Vertical Tank (Walls & Roofs)*"; http://www.industry.foamglas.com/en/industry/applications/tanks_spheres_vessels/vertical_systems/; printed Jul. 20, 2016; (4 pages).

"*Foamglass Used as an Insulator in LPG Storage Reservoirs*"; Tech Du Petrol, vol. 21, No. 239, pp. 41-42, Mar. 1966 (in French); (2 pages).

Pittsburgh Corning Foamglass Insulation; "*Foamglass Cellular Glass Insulation is Proven Value*"; (12 pages).

Dudzinski, S. J.; "*Method for Capping Cellular Glass Blocks for the Load Bearing Insulation of Liquefied Gas Storage Tanks*"; SciTech Connect, Feb. 17, 1978; (2 pages).

* cited by examiner

THERMALLY INSULATED RESERVOIR

CROSS-REFERENCE TO RELATED APPLICATIONS

This application is a continuation of and claims the benefit and priority of international application No. PCT/RU2014/000222, titled THERMALLY INSULATED RESERVOIR and filed on Mar. 28, 2014, also published as WO/2015/147687.

FIELD

The invention relates to a device for heat insulation of tanks, such as cylindrical vertical steel tanks having a volume between 200-20,000 $m^3$ used for storage of oil and oil products.

BACKGROUND

The task of storing oil in tanks is important and relevant to many of industries including oil production, energy, mechanical engineering, and the like. Often, oil and oil products are stored in metal tanks for relatively long periods of time. Thus, the task of oil storage in tanks includes many subtasks that are based on properties of oil. One such subtask is heat insulation of tanks. Because oil may freeze at temperatures between −60 degrees Celsius (−60° C.) and 30° C., and because it may begin to boil at temperatures as low as 28° C., depending on its contents, requirements for controlling the temperature inside the tank are relatively strict. Moreover, the task of heat insulation is significantly complicated in oil producing sites with harsh and often extreme natural conditions.

To resolve the task of tank heat insulation, the range of materials and structures varies significantly depending on natural conditions and other factors. Traditionally, polyurethane, mineral wool plates, cellular glass, and the like are used as heat-insulating materials. Cellular glass is the most suitable material in extreme weather conditions. This is because heat-insulating and mechanical characteristics of cellular glass do not change over a relatively large range of temperatures and humidity. Another important factor is that cellular glass is a noncombustible material. The high risk of fire associated with oil and oil product tanks is taken into account during selection of materials and heat-insulating methods.

Various solutions are known in the art for insulation of such tanks.

U.S. Pat. No. 4,073,976 (published on Feb. 14, 1978, IPC F17C13/00) discloses a tank (for storage of the liquefied gas) where foam glass blocks are used as a load-bearing insulation at a bottom of the tank. The blocks are covered by a layer of vermiculite particles that provide for higher resistance to a pressure load.

U.S. Pat. No. 4,062,468 (published on Dec. 13, 1977, IPC B65D90/06) discloses an insulation system for big tanks that store fuel. The aim of the disclosure is to increase the cost effectiveness of insulation and its resistance to natural effects. The insulation includes panels of foam glass insulating material fixed on the tank wall and supported by metal rails. A layer of resinous material reinforced by fiber cloth is positioned on an exterior of the insulation.

U.S. Pat. Pub. No. 2012/0325821 (published on Dec. 27, 2012, IPC F17C13/00) discloses a cryogenic tank that includes a welded internal tank and an outer shell that surrounds the welded internal tank. The tank also includes concrete foundation that includes a raised part. The tank also includes multiple cellular glass blocks installed on the raised part of the concrete foundation and a leveling concrete layer that coats the top layer of the foam glass blocks. The tank also includes a fastening device fixed in the concrete foundation. The welded internal tank is installed on the leveling concrete layer and an external shell is fixed on the fastening device along the perimeter of the external shell. The annular space between the internal tank and the external shell is filled with perlite.

R.F. patent No. 117467 (published on Jun. 27, 2012, IPC E04B1/76) discloses a heat-insulated coating that includes \foam glass blocks made in shape of a compressed prism. Liquid ceramic heat insulation is used to fasten foam glass blocks to the foundation of the protected structure and to each other.

U.S. Pat. No. 8,381,939 (published on Feb. 26, 2013, IPC E03B11/00) discloses an insulated storage facility that includes modular panels and structures that are stiff enough to store hot and cold liquids. The insulated storage facility is includes multiple insulating panels installed on an insulated supporter to form a cylindrical wall. Insulating panels have a relatively hard structure and support an internal pad. The cylindrical wall of insulating panels is supported by a thin external case. This insulated storage facility also includes a lid supported by insulating panels and that covers the contents of the storage facility.

However, known technical solutions do not provide structural elements that compensate for deformations of the wall of the protected structure during its operation. If deformations of the tank wall appear, the risk of destruction of the heat-insulated layer is high. Moreover, solutions do not provide the quick access to the surface of the tank for its technical maintenance and repair.

U.S. Pat. No. 8,615,946 (published on Dec. 31, 2013, IPC E04B7/00) discloses an insulated wall system that may be used as heat insulation of industrial structures. Heat insulation includes heat-insulating blocks made of any insulating material known in this field, including but not limited by polystyrene, polyurethane, polyisocyanurate, their mixtures, or the like. The insulated wall system includes many metal gratings installed parallel to and separated from each other. The system also includes multiple external panels, each of which is attached to metal gratings formed on the external coating. The system also includes multiple heat-insulating blocks each of which is installed between the metal grating and the external panel. The system also includes a plank between the heat-insulating blocks and the external panel, the plank having a step that fixes the heat-insulating block and decreases mutual side movements of the heat-insulating block and the plank. The system also includes a fastener that fastens the external panel, the plank and the heat-insulating block together with the metal grating. An adhesive layer may be used between the block and the metal grating to make the assembly of the insulated wall simpler. The adhesive material may include, for example, contact adhesives, reactive adhesives (for instance, epoxy resin, acrylate etc.), pressure sensitive adhesives, hot-melt adhesives, or the like.

The drawback of this technical solution is that the structure is extra hard, which may lead to destruction of the hard heat-insulating material where the tank wall has been deformed during operation.

The technical solution that is the closest to the present solution is a heat-insulated tank known disclosed by RF patent No. 2079620 (published on 20, May 2007, IPC E04H7/04). The tank includes elements tightly fixed on the tank body as horizontal bandages with a coat, and heat-insulating panels installed on them. The bandages are made as angles, fixed on the tank body using preassembled supports. The bandages are along a height of the body at distances between 2 meters (m) and 4 m above each other. The heat-insulating panels are formed as semi-hard mineral or slaggy blocks.

However, this technical solution does not provide adequate strength and safety of the tank heat insulation under loads caused by filling or discharge of the raw material or by environmental factors.

SUMMARY

The objective of the invention is the production of a heat-insulated tank that is designed to accommodate cyclic loads to its structure (i.e., loads due to technological procedures of filling and discharging the oil and oil products from the tank). The tank is designed to preserve the temperature of the stored fluid under severe weather conditions, such as temperatures reaching minus 60° C., and to provide safety for the heat insulation.

The technical result is increased strength of the tank heat insulation during loads at its structure (i.e., increased resistance to deformations) caused by filling and discharge of the raw material as well as by environmental factors. The temperature of the stored product is preserved and safety of the heat insulation is provided. Moreover, application of the suggested method provides for the protection of the each from the heat impact of the product stored in the tank (including avoidance of the soil thaw). Furthermore, the result provides for dismantlement and the repeated assemblage of the tank heat insulation for technical maintenance and repair.

The set objective is achieved by providing a heat-insulated wall, roof and bottom of the heat-insulated tank. The tank is installed on a foundation. The heat-insulated wall and roof of the tank is equipped with supporting discharge skirts installed in such a way as to form sections. The heat insulation coating is made of foam glass blocks that fill the sections. Control joints are formed in the heat insulation coating, and a top coat made of metal sheets is installed on the external surface of all of the foam glass blocks except for foam glass blocks in a lower section. At the lower section, foam glass blocks are installed at least in a single row between a lower supporting skirt and an edge of the tank foundation. The lower foam glass blocks are made detachable. The remaining foam glass blocks have a cross shaped cut to be positioned adjacent to a side of the tank surface and fixed on the tank surface and linked to each other using adhesive material. Several rows are formed offset from blocks in neighboring rows. Control joints are formed as spaces between blocks that are filled by a butyl rubber sealing compound.

The heat insulation coating of the tank wall is equipped with at least one horizontal control joint and at least one vertical control joint located in each section except for the lower section. Heat insulation coating of the tank roof is also provided with control joints oriented radially with respect to the tank roof.

Detachable blocks of the lower section are made to have cushion layers placed on multiple sides of the block. The cushion layers provide for a relatively tight attachment of blocks to each other. The cushion also provides for detachment of lower section blocks. The external surface of the detachable blocks is equipped with a metal plate to provide mechanical protection of the removable blocks.

Supporting discharge skirts are fixed on the tank wall and roof and are positioned at distances between 1.5 m and 2 m apart.

Supporting discharge skirts are fixed on the tank wall and roof using fastening elements made of the tank material. The skirts include a plate welded to a supporting point and oriented perpendicular to the plate. The supporting discharge skirt is fastened to the supporting point, for instance, by welding. The supporting discharge skirts are made as beams or angled elements.

Fastening elements of the supporting discharge skirts are welded to the tank surface about the perimeter of the side wall and the circumference of the roof at distances that do not exceed 1.5 m.

Metal sheets of the top coat are attached to supporting discharge skirts using thread-cutting screws with seal rubber pads.

Foam glass blocks for heat insulation of the tank wall and roof are selected to have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.7 Megapascals (MPa), a density of between 115 kilograms per cubic meter ($kg/m^3$) and 180 $kg/m^3$, a length and width of about 450 mm by 300 mm and thickness of between 25 mm and 125 mm.

Foam glass blocks in each row of each section are installed with horizontal offset relative to the neighboring row, such as an offset of half of the length of the blocks.

The shock cushions of the foam glass blocks in the lower section include cellular rubber substance that is 20-25 mm thick. The cellular rubber may include, for instance, of brands such as K-Flex, Armaflex. The cellular rubber may be fixed along a perimeter of the block.

A metal plate is positioned on an external surface of the detachable blocks and may include a galvanized steel plate that is 0.7 mm thick, with a permitted deflection of 0.08 mm. The plate is made with an anticorrosive coating on an external side.

A polyurethane sealing compound, such as one available as 3M, is used as the adhesive material for fastening the foam glass blocks to the tank surface and to each other.

The volume of the heat-insulated tank is between 200 $m^3$ and 20,000 $m^3$.

At least three supporting discharge skirts are installed on the tank wall.

The horizontal control joint is installed between the second and the third supporting discharge skirts and vertical control joints are installed about the tank perimeter and separated by between 4.5 m and 5.5 m.

The selected size of a space for forming the vertical and horizontal control joints is about 20 mm plus or minus 3 mm.

Galvanized steel sheets are used for the metal sheets for the top coat of the tank wall and roof to provide for protection of blocks from mechanical damage. The sheets are 0.7 mm thick with a permitted deflection of 0.08 mm, and are made with an anticorrosive coating on an external side.

Corrugated galvanized steel sheets are used as the top coat of the tank wall and smooth galvanized steel sheets are used as the top layer of the roof. The sheets are fastened using thread-cutting screws spaced apart by about 300 mm plus or minus 5 mm, and overlapping points of the top coat sheets are fastened using aluminum pop-rivets spaced apart by about 300 mm plus or minus 5 mm.

Metal sheets of the top coat are glued to foam glass blocks using the adhesive.

The cross shaped cut is made such that the cross-section shape is a semicircle having a diameter of 20 mm with a permitted deflection of 2 mm.

The foundation includes reinforced concrete pilework, a leveling layer located above the reinforced concrete pilework, an asphalt mastic layer located above the leveling layer, a heat-insulating layer made of foam glass blocks located above the asphalt mastic layer, and the waterproofing layer above the asphalt mastic layer. The joints between foam glass blocks are filled by the asphalt mastic.

Foam glass blocks with following characteristics are used in the foundation: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.9 Megapascals (MPa), a density of between 130 kilograms per cubic meter (kg/m$^3$) and 180 kg/m$^3$, a length and width of about 450 mm by 600 mm and thickness of between 40 mm and 180 mm.

Cement screed or medium-grained sand layer is used as the leveling layer and is at least 50 cm thick.

Asphalt concrete is used as the waterproofing layer and has, for instance, I-III marks and is between 1 mm and 3 mm thick.

Joints between foam glass blocks of the foundation are filled with the asphalt mastic that is 3 mm plus or minus 1 mm wide.

The tank roof is equipped with a cap as an extension of the roof top coat at the point of jointing with the wall top coat.

Pipe branches and lids of the tank are equipped with heat insulation.

Collars made of 5 mm thick steel sheet are installed at pipe branches and lids of the tank.

The top sheet is attached to the collar using thread-cutting screws installed at pipe branches and lids of the tank.

Weather-proof epoxy- and polyurethane-based anticorrosive coatings are used as the anticorrosive coating.

The set objective is also solved by the fact that the heat-insulating block for heat insulation of the tank is made of foam glass in a rectangular parallelepiped shape and is equipped with the cross shaped cut to be filled by the adhesive material for subsequent fastening of the block to the tank surface. The cross shaped cut is made by two crossing groves with a cross section shape of a semicircle having a diameter of 20 mm with a permitted deflection of 2 mm.

Grooves are made to cross in the center of the block face that touches the tank surface, to extend through the whole surface of the block, and to cross each other at a right angle.

BRIEF DESCRIPTION OF THE DRAWINGS

The features of the disclosure are illustrated by the following drawings.

DETAILED DESCRIPTION

Figure 1:
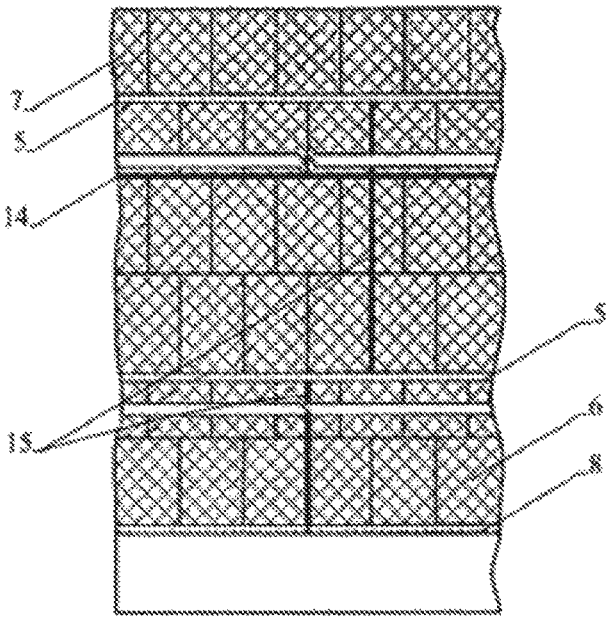
FIG. 1 illustrates a front side view of a scheme of the heat insulation on the tank wall.

The drawings include the following elements along with their corresponding reference numbers:

1—tank bottom,
2—tank wall,
3—tank roof,
4—tank pipe branches and lids,
5—tank supporting discharge skirt,
6—section between supporting discharge skirts,
7—foam glass blocks for heat insulation of the tank wall and roof,
8—lower supporting discharge skirt,
9—tank corner weld joint "bottom-room" (edge of the tank foundation),
10—detachable foam glass blocks,
11—shock sealing cushions of detachable blocks,
12—metal plate of the detachable block,
13—adhesive material,
14—horizontal control joint in heat insulation of the tank wall,
15—vertical control joint in heat insulation of the tank wall,
16—top coat of the tank wall heat insulation,
17—top coat of the tank roof heat insulation,
18—plate of the fastening element,
19—supporting point to fasten the supporting discharge skirt thereon,
20—thread-cutting galvanized screws with sealing rubber pads,
21—pop-rivets,
22—reinforced concrete pilework,
23—leveling level,
24—asphalt mastic layer,
25—foam glass blocks for heat insulation of the tank bottom,
25—waterproofing layer,
27—extension of the tank roof,
28—collars of pipe branches and lids on tank wall and roof,
29—rider sheet of tank pipe branches and lids,
30—top sheet of tank pipe branches and lids.

The heat-insulated tank includes a heat-insulated cylindrical wall 2, a roof 3, and a bottom 1 installed on a foundation. The tank wall and roof are equipped with supporting discharge skirts 5 that form sections 6. The sections 6 are filled with a heat-insulating layer made of foam glass blocks 7. Control joints 15 are formed within the foam glass blocks 7. A top coat 16, 17 made of metal sheets is located at an external surface of the foam glass blocks 7 at locations other than the lower section (between a lower supporting discharge skirt 8 and an edge of the tank foundation 9).

Figure 7:
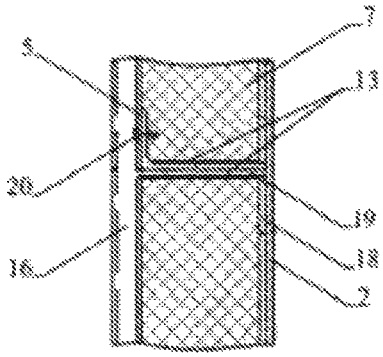
FIG. 7 illustrates a scheme for fastening of supporting discharge skirts.

Supporting discharge skirts 5 are made, for instance, of steel beams or angle elements that are tightly fixed along the perimeter of the tank using fastening elements. For example, the discharge skirts 5 are fastened circumferentially about the tank wall 2 and the tank roof 3. Fastening elements are made of the tank material (steel) and they include a plate 18 welded to a supporting point 19 in a perpendicular manner, for example, by welding the supporting discharge skirt (with brief reference to FIG. 7). Supporting discharge belts are fastened at intervals of between 1.5 m and 2 m. If the distance between skirts exceeds 2 m, the heat-insulating material will be deformed. If the distance between skirts is less than 1.5 m, the metal intensity of the structure will be significantly increased.

Figure 6:
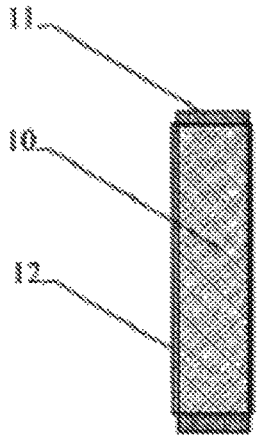
FIG. 6 illustrates generally a quick-detachable heat-insulating element of a corner weld joint in a "wall-bottom" of a tank.

Foam glass blocks are installed in the lower section (i.e., below the lower skirt 8 in at least one row, and are made detachable 10. This provides the opportunity to quickly remove the detachable blocks 10 in order to provide easy access to the corner weld joint "wall-bottom" 9. The detachable blocks 10 are equipped with shock sealing cushions 11 (with brief reference to FIG. 6) that are between 20 mm and 25 mm thick. The cushions 11 are made, for instance, using a cellular rubber substance (i.e., foam rubber) of K-Flex or Armaflex brands. The sealing cushions 11 are glued around the perimeter of the block on its butt sides (lower, top and two side ones). The cushions 11 enable a relatively tight attachment of blocks 10 to each other and, if necessary, enable relatively easy removal of the lower section blocks.

The metal plate 12 is a smooth galvanized steel sheet and is 0.7 mm thick with a permitted deflection of 0.08 mm. The plate 12 includes an anticorrosive coating on the external side, and is installed on an external surface ("facade") of the detachable blocks 10 using asphalt mastic. The plate 12 provides mechanical protection of the blocks 10 against mechanical damage. To protect the metal plate 12 with the anticorrosive coating against mechanical damage, it can be also installed on an internal surface of the block. Dimensions of the detachable blocks 10 are determined based on the location of the lower supporting skirt.

Remaining sections of the tank wall 2 and tank roof 3 are filled with foam glass blocks 7 oriented in several rows. Blocks of adjacent rows in each tier 6 are offset from each other, as shown in FIG. 1. For example, the offset may be half of a length of the blocks 7.

Blocks 7 are attached to the tank surface and to each other using an adhesive material 13, such as a polyurethane sealing compound from 3M. Joints between neighboring blocks and joints between blocks and structural elements of the tank are filled with the polyurethane sealing compound. The foam glass blocks 7 have a rectangular parallelepiped shape with geometrical dimensions of 450 mm by 300 mm and have a thickness between 25 mm and 125 mm. The blocks 7 have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.7 Megapascals (MPa), and a density of between 115 kilograms per cubic meter (kg/m$^3$) and 180 kg/m$^3$.

A cross shaped cut formed by cutting two grooves (cavities) that intersect at a right angle at the center of the block face. The cut is made on the side of the block 7 that contacts the tank surface. The grooves have a cross-sectional shape of a semicircle having a diameter of 20 mm with a permitted deflection of 2 mm. The cuts run across the whole surface of the block up to its ribs.

Figure 2:
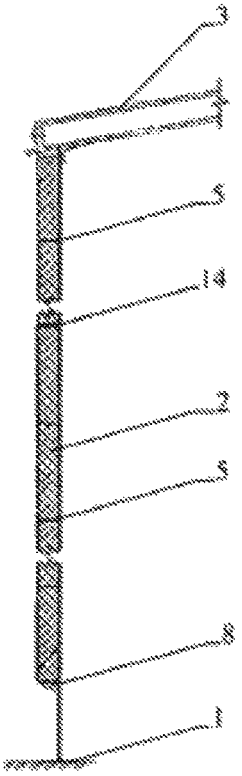
FIG. 2 illustrates a side view of the scheme of the heat insulation on the tank wall of FIG. 1.

The heat insulation coating of the tank wall is equipped, at least, with one horizontal control joint 14, and with at least ten vertical control joints 15. The vertical control joints 15 are located in each section except the lower one (with reference to FIGS. 1 and 2). The heat insulation coating of the tank roof 3 is equipped at least with ten control joints, located in each section and oriented radially. Control joints are made by forming spaces between blocks and filling the spaces with a butyl rubber sealing compound. Vertical control joints 15 are located at every 5 m along the tank perimeter and the horizontal joint 14 is located, for instance, between the second and the third supporting discharge skirts (at the center, as shown in FIG. 1). Control joints preserve the integrity of the heat insulation in response to deformation of the tank caused by external mechanical loads.

The external surface of foam glass blocks 7 at the tank wall and roof is covered by a top coat 16, 17 made of metal sheets. The top coats 16, 17 protect the blocks 7 from mechanical damage and environmental impacts. The metal sheets are made of galvanized steel that is 0.7 mm thick with a permitted deflection of 0.08 mm and have an anticorrosive coating on an external side. The top coat 16 of the tank wall 2 has a profile height between 10 mm and 35 mm and a width of at least 1,000 mm. Smooth sheets of at least 1,000 mm wide are used for the top coat 17 on the tank roof 3.

Weather-proof anticorrosive epoxy- and polyurethane-based coatings are used as an anticorrosive coating of the tank wall 2, roof 3, and pipe branches and lids.

Figure 5:
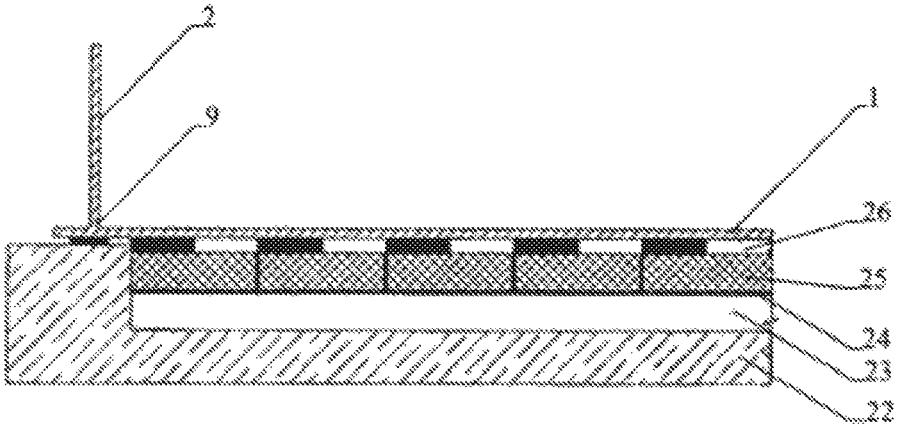
FIG. 5 illustrates a side view of a scheme of heat insulation on a tank bottom.

The foundation for installation of the heat-insulated tank includes reinforced concrete pilework 22, a leveling layer 23 located on the reinforced concrete pilework 22, an asphalt mastic layer 24 located on the leveling layer 23, a heat-insulating layer of foam glass blocks 25 located on the asphalt mastic layer, and a weather-proof layer 26 located on the heat-insulating layer. The joints between foam glass blocks 25 are filled with the asphalt mastic (with brief reference to FIG. 5).

The leveling layer is made, for instance, of cement screed or medium-grained sand layer, and is at least 50 cm thick. The asphalt concrete layer may be made of I-Ill brands and be 1-3 mm thick is used as a waterproofing layer. The foam glass blocks 25 of the foundation heat-insulating layer have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.9 Megapascals (MPa), a density of between 130 kilograms per cubic meter (kg/m$^3$) and 180 kg/m$^3$, a length and width of about 450 mm by 600 mm and thickness of between 40 mm and 180 mm. Foam concrete blocks may also be used as the heat-insulating material of the tank bottom.

The heat-insulated tank is made as follows.

The foundation (base) is prepared on which the cylindrical tank is assembled. Tank assembly includes installation of the tank bottom 1 and assemblage of the tank wall 2 and roof 3, upon which load-bearing structures—supporting discharge skirts 5 that form sections 6—are fixed by fastening elements. The skirts 5 support the foam glass blocks. Fastening elements of the supporting discharge skirts 5 are welded to the tank surface along the perimeter of the side wall 2 at locations separated by 1.5 m or less.

After the fastening elements are installed, the tank external surface and load-bearing structures for fastening of the heat insulation are protected with weather-proof anticorrosive coatings. Then foam glass (cellular glass) blocks 7 are installed section by section on the supporting discharge skirts 5. Detachable foam glass blocks 10 are installed in a single row in the lower section—between the lower supporting skirt 8 and the edge of the tank foundation 9 (around the corner weld joint). Remaining sections of the tank wall and roof are filled in by several rows of the foam glass blocks 7 having the cross shaped cut. The foam glass blocks 7 are attached to the tank surface and to each other using the adhesive material 13.

To fasten blocks to the tank surface, the cross shaped cut is fully filled by the polyurethane sealing compound, which extends for between 8 mm and 12 mm above the block surface to provide improved adhesion of the block to the tank surface. During fastening of blocks 7 on the tank surface, some blocks are spaced by 20 mm plus or minus 3 mm from a neighboring block to form control joints. The space is then filled with butyl rubber sealing compound, for instance, of 3M brand. To make the vertical control joint of the tank wall 2 and the control joint of the tank roof 3 continuous, foam glass blocks are trimmed on the spot. Joints between neighboring blocks as well as joints between blocks and structural elements are filled with a polyurethane sealing compound that is applied along the perimeter of the blocks. The width selected for the layer of the polyurethane sealing compound is 3 mm plus or minus 1 mm. This width provides for balance between the strength of the joint and the elasticity of the structure.

Scaffolding may be made to aid in installation of the heat insulation. When a section of heat insulation is installed along the perimeter of the tank, the scaffolding is moved along the tank and the neighboring section of heat insulation is installed at the entire height.

Figure 8:
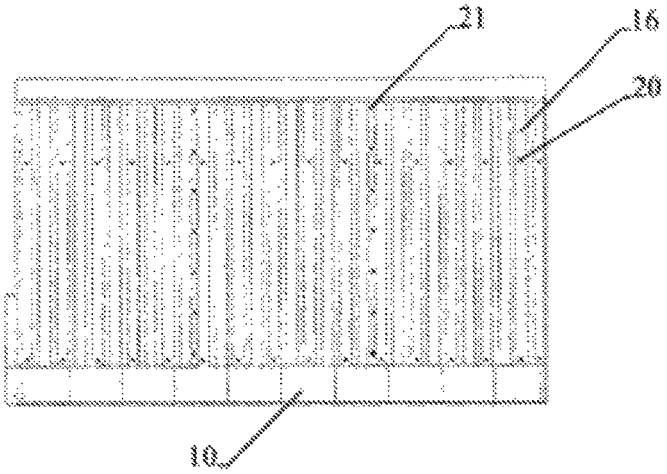
FIG. 8 illustrates a front view of a scheme for fastening of a top coat on a tank wall.

After installation of the heat insulation, the top coat is installed. Metal sheets of top coat 16, 17 are glued to the external surface of the foam glass blocks 7 at the tank wall 2 and roof 3 (for instance, using polyurethane sealing compound). The top coat 16, 17 is also fastened to supporting discharge skirts 5 using thread-cutting galvanized screws 20 with sealing rubber pads. Thread-cutting screws 20 are installed to bores mutually drilled in the sheet and in the supporting discharge skirt 5 (with brief reference to FIG. 7). The sheets are fastened at a spacing of about 300 mm plus or minus 5 mm along the perimeter of the tank. This provides for tight attachment of the sheets to each other and to the heat-insulating layer. The overlapping points of the top coat sheets are also attached using aluminum pop-rivets 25 spaced by about 300 mm plus or minus 5 mm (with brief reference to FIG. 8). The amount of overlap in the horizontal plane and the vertical plane is about 50 mm plus or minus 5 mm. Selected values provide preservation of the mutual position of sheets and integrity of the structure at longitudinal and transverse movements of the tank wall.

Figure 3:
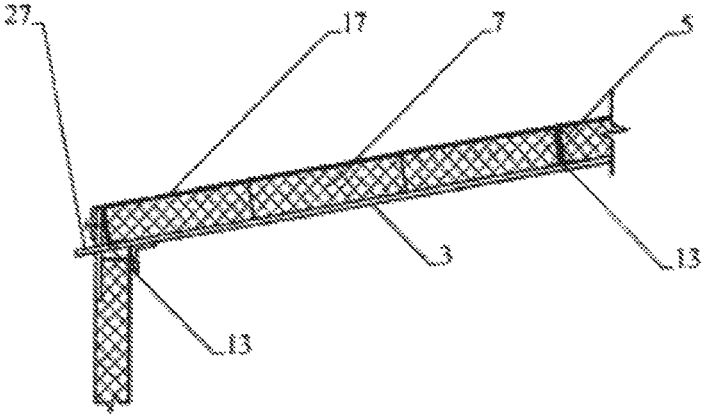
FIG. 3 illustrates a side view of a scheme of heat insulation on a tank roof

To prevent the tank wall 2 from pollution by mud flows, a step is made on the roof 3, (i.e., an extension 27). The extension 27 is located at the joint between the roof 3 and the wall top coat (with brief reference to FIG. 3). To fasten the top coat 17, lay-in type panels made of thin sheet galvanized steel are installed at the surface of the top wall blocks. Sheets of the top coat are fastened to lay-in type panels by thread-cutting galvanized screws with sealing rubber pads. The screws and pads are installed into holes mutually drilled in the sheet and in the lay-in type panel.

Figure 4:
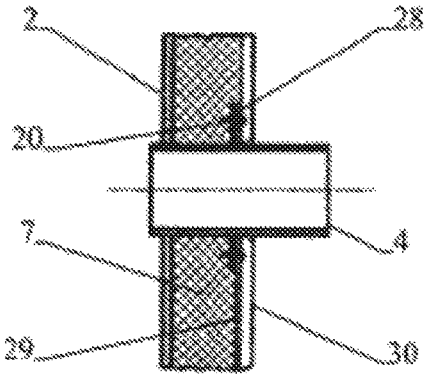
FIG. 4 illustrates a front view of a scheme of heat insulation of lids and pipe branches on a tank wall.

Collars 28 made of a steel sheet that having a thickness of 5 mm are installed on pipe branches and lids of the tank wall 2 and roof 3 by of welding (with brief reference to FIG. 4). To reinforce insertions of pipe branches and lids, a rider sheet 29 made of thin sheet galvanized steel is installed under the top sheet 30. The top sheet 30 on pipe branches and lids is coupled to the collar 28 and the rider sheet 29 by thread-cutting screws 20. Points of attachment between the top sheet and the collar are sealed using mastic.

Installation of the heat insulation for the tank bottom 1 includes the installation of the reinforced concrete ring (pilework) 22 on which the leveling layer 23 is laid. The leveling layer 23 is used to level the surface for laying of foam glass blocks (with brief reference to FIG. 5). The leveling layer is covered with the asphalt mastic layer 24 and the heat-insulating layer made of foam glass blocks 25. During installation of the heat-insulating level, onsite tipping of foam glass blocks is allowable. Joints between blocks are filled with asphalt mastic (as the adhesive for the bottom) and the mastic layer is 3 mm plus or minus 1 mm wide. The waterproofing layer 26 is laid on the heat-insulating layer. It is used to protect the tank bottom 1 from surface corrosion as well to evenly distribute the load on the heat insulation and to remove local load concentrations during installation and operation of the tank.

The suggested structural version of the tank provides for preservation of the integrity of its heat insulation at longitudinal and transverse movements of the tank wall. The tank also provides for insulation of the tank walls, roof and bottom from the impact of low surrounding temperatures and prevents the product stored in the tank from cooling and the soil from thawing. The constructive version of the heat insulation provides for dismantlement and the repeated assemblage for technical maintenance and repair of the tank, including the quick access to the corner weld joint of the tank wall.

The invention claimed is:

1. A heat-insulated tank for holding oil in extreme climates, comprising:

a wall, a roof and a bottom each installed on a foundation;

supporting discharge skirts fastened circumferentially around an exterior of the wall and the roof, defining sections wherein the discharge skirts support foam glass blocks;

a heat-insulated layer having the foam glass blocks positioned in the sections and defining at least one vertical control joint and one horizontal control joint wherein the at least one vertical control joint and the at least one horizontal control joint include a rubber material positioned between the foam glass blocks, the foam glass blocks including a lower row of foam glass blocks that include detachable foam glass blocks and additional rows of foam glass blocks coupled to the exterior of the tank via an adhesive above the lower row and oriented such that at least one row of foam glass blocks is offset from at least another row of foam glass blocks; and at least one corrugated metal sheet coupled to an outer surface of at least some of the foam glass blocks.

2. The heat-insulated tank of claim 1, wherein the detachable blocks include shock cushions positioned on sides of the block that provide for relatively tight attachment of the detachable blocks to each other and for removal of the detachable blocks, and wherein an external surface of the detachable blocks is coupled to a metal plate for protecting the detachable blocks from mechanical damage.

3. The heat-insulated tank of claim 1, wherein the supporting discharge skirts are separated in a vertical direction by between 1.5 meters (1.5 m) and 2 m.

4. The heat-insulated tank of claim 1, further comprising fastening elements that include a same metal as the heat-insulated tank that are configured to fasten the supporting discharge skirts to the wall and the roof by being welded to a supporting point.

5. The heat-insulated tank of claim 1, wherein the fastening elements are welded to a surface of the tank surface about a perimeter of the surface and separated by less than or equal to 1.5 m.

6. The heat-insulated tank of claim 1, wherein the at least one metal sheet is coupled to the supporting discharge skirts using thread-cutting screws with sealing rubber pads.

7. The heat-insulated tank of claim 1, wherein the foam glass blocks for the heat insulation of the tank wall and roof have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.7 Megapascals (MPa), and a density of between 115 kilograms per cubic meter (kg/m$^3$) and 180 kg/m$^3$.

8. The heat-insulated tank of claim 1, wherein the at least one row of foam glass blocks is offset from the at least another row of foam glass blocks by a distance equal to half of a length of a foam glass block.

9. The heat-insulated tank of claim 1, wherein the supporting discharge skirts include at least three supporting discharge skirts.

10. The heat insulated tank of claim 1, wherein the rubber material comprises butyl rubber.

11. A heat-insulated tank for holding oil in extreme climates, comprising:

a wall, a roof and a bottom each installed on a foundation;

supporting discharge skirts fastened circumferentially around an exterior of the wall, defining sections wherein the discharge skirts support foam glass blocks;

a heat-insulated layer having the foam glass blocks positioned in the sections including:

a lower row of detachable foam glass blocks, and additional rows of foam glass blocks on a surface that contacts the heat-insulated tank and being coupled to each other and to the exterior of the tank via adhesive, at least some of the additional rows of foam glass blocks being offset from each other in a horizontal direction;

at least one horizontal control joint and at least two vertical control joints formed in the additional rows of foam glass blocks of the heat-insulated layer on the wall of the heat-insulated tank and having a butyl rubber sealing compound positioned in spaces between at least some of the additional rows of foam glass blocks;

at least two radial control joints formed in the additional rows of foam glass blocks of the heat-insulated layer on a roof of the heat insulated tank and having a butyl rubber sealing compound positioned in spaces between at least others of the additional rows of foam glass blocks; and a top coat having metal sheets positioned on an external surface of at least some of the foam glass blocks including at least one sheet of galvanized steel having a thickness of 0.7±0.08 mm with anticorrosive coating on the outside coupled to the additional rows of foam glass blocks above the lower row of foam glass blocks and fastened to the discharge skirt with sealing gaskets.

12. The heat-insulated tank of claim 11, wherein the at least one horizontal control joint is located between a second and a third supporting discharge skirts and the at least two vertical control joints are spaced about a perimeter of the heat-insulated tank by a distance of between 4.5 m and 5.5 m.

13. The heat-insulated tank of claim 11, wherein the spaces between the at least some of the additional rows of foam glass blocks is between 17 mm and 23 mm wide.

14. The heat-insulated tank of claim 11, wherein the top coat includes corrugated galvanized steel sheets as a roof top coat and smooth galvanized steel sheets as a wall top coat, wherein at least some of the metal sheets are fastened using thread-cutting screws separated by between 295 mm and 305 mm.

15. The heat-insulated tank of claim 11, wherein metal sheets of the top coat are glued to foam glass blocks using an adhesive.

16. The heat-insulated tank of claim 11, wherein has a semicircular cross-sectional shape having a diameter of 20 mm and a permitted deflection of 2 mm.

17. The heat-insulated tank of claim 11, wherein the foundation includes a reinforced concrete pilework, a leveling layer located at the reinforced concrete pilework, an asphalt mastic layer located at the leveling layer, a foundation heat-insulating layer made of foam glass blocks with asphalt mastic therebetween and located at the asphalt mastic layer, and a waterproofing layer located at the foundation heat-insulating layer.

18. The heat-insulated tank of claim 17, wherein the foam glass blocks of the foundation heat-insulating layer have the following characteristics: a thermal conductivity of no more than 0.05 watts per square meter of surface area for a temperature gradient of one kelvin for every meter thickness (0.05 W/mK), a vapor permeability of 0 mg/mhPa, being in the NG flammability group, a crushing strength of at least 0.9 Megapascals (MPa), and a density of between 130 kilograms per cubic meter (kg/m$^3$) and 180 kg/m$^3$.

19. The heat-insulated tank of claim 11, further comprising pipe branches and lids equipped with a heat insulation.

20. The heat-insulated tank of claim 19, further comprising collars made of a steel sheet installed on the pipe branches and lids.

* * * * *